US006083678A

United States Patent [19]

Verrept et al.

[11] Patent Number: 6,083,678

[45] Date of Patent: Jul. 4, 2000

[54] METHOD FOR PREPARING A LIGHT-SENSITIVE EMULSION HAVING (100) TABULAR GRAINS RICH IN SILVER CHLORIDE

[75] Inventors: Peter Verrept, Avelgem; Jan Cuypers, Tessenderlo, both of Belgium

[73] Assignee: Agfa-Gevaert, N.V., Mortsel, Belgium

[21] Appl. No.: 09/168,866

[22] Filed: Oct. 9, 1998

Related U.S. Application Data

[60] Provisional application No. 60/068,526, Dec. 22, 1997.

[30] Foreign Application Priority Data

Oct. 24, 1997 [EP] European Pat. Off. ..... 97203311

[51] Int. Cl.[7] ..... G03C 1/015; G03C 1/047; G03C 1/08

[52] U.S. Cl. ..... 430/569; 430/567; 430/642; 430/604; 430/605

[58] Field of Search ..... 430/567, 569, 430/604, 605, 642

[56] References Cited

U.S. PATENT DOCUMENTS

| | | | |
|---|---|---|---|
| 5,527,664 | 6/1996 | Kikuchi et al. | 430/569 |
| 5,707,793 | 1/1998 | Oyamada | 430/567 |
| 5,885,763 | 3/1999 | Verrept et al. | 430/569 |

FOREIGN PATENT DOCUMENTS

| | | |
|---|---|---|
| 0 672 940 A2 | 9/1995 | European Pat. Off. . |
| 0 672 940 A3 | 1/1997 | European Pat. Off. . |
| 0 762 192 A1 | 3/1997 | European Pat. Off. . |
| 0 843 207 A1 | 5/1998 | European Pat. Off. . |

OTHER PUBLICATIONS

Derwent—XP002071828 & JP 09 005 911 (Fuji Photo Film Co Ltd) Jan. 10, 1997 & US 5,707,793 A, Jan. 13, 1998.

*Primary Examiner*—Mark F. Huff

*Attorney, Agent, or Firm*—Breiner & Breiner

[57] ABSTRACT

A method has been described for preparing a light-sensitive silver halide photographic emulsion comprising performing at least three distinct precipitation steps in an aqueous medium into a reaction vessel, followed by desalting by means of flocculation and washing or by means of ultrafiltration, said emulsion comprising a colloidally stabilizing binder and {100} tabular silver halide grains containing at least 50 mole % of silver chloride, wherein at least 60% by number of all grains is provided by said tabular grains, and wherein said tabular grains exhibit an average aspect ratio of at least 2, an average thickness of at most 0.25 μm with a variation coefficient of at most 0.25, and an average equivalent circular crystal diameter of 0.3 μm or more with a variation coefficient of at most 0.20;

said three distinct precipitation steps being a nucleation step and two growth steps, said method being further characterized by introducing after ending the said nucleation step one or more crystal dislocation(s) onto nuclei formed in the said nucleation step in order to provide anisotropic growth of the said nuclei into {100} tabular grains, wherein introducing said crystal dislocation(s) is performed within a time taking no longer than the time required to perform a first physical ripening step after the nucleation step in order to get a number of dislocation lines of less than 5, in one and the same crystallographic plane, and wherein said physical ripening step between introducing said dislocation(s) and growing the nuclei having said dislocation(s) in a first growth step proceeds within a time interval from 2 to 10 minutes, and more preferably from 5 to 10 minutes.

8 Claims, No Drawings

METHOD FOR PREPARING A LIGHT-SENSITIVE EMULSION HAVING (100) TABULAR GRAINS RICH IN SILVER CHLORIDE

This application claims the benefit of U.S. Provisional Application Ser. No. 60/068,526, filed Dec. 22, 1997.

FIELD OF THE INVENTION

The present invention deals with a preparation method of a light-sensitive silver halide emulsion rich in silver chloride having {100} tabular grains.

BACKGROUND OF THE INVENTION

High aspect ratio tabular grains exhibit several pronounced photographic advantages. Thanks to their particular morphology greater amounts of spectral sensitizers can be adsorbed per mole of silver halide if compared with classical globular grains. As a consequence such spectrally sensitized tabular grains show an improved speed-granularity relationship and a wide separation between their blue speed and minus blue speed. Sharpness of photographic images can be improved using tabular grains thanks to their lower light scattering properties, again if compared with conventional globular emulsion grains. In colour negative materials e.g. the conventional sequence of the light-sensitive layers can be altered and the yellow filter layer can be omitted. In developed black-and-white images high covering power is obtained even at high hardening levels. Alternatively reduced silver halide coverages can be achieved if desired, which again results in improved sharpness. In duplitized radiographic materials the presence of tabular grains reduces the so-called cross-over which is the main factor for sharpness in such materials. Moreover coating amounts of silver can be reduced, further in favour of production cost an ecology.

An emulsion is generally understood to be a "tabular grain emulsion" when tabular grains account for at least 50 percent of the total grain projected area. A grain is generally considered to be a tabular grain when the ratio of its equivalent circular diameter to its thickness is at least 2. The equivalent circular diameter of a grain is the diameter of a circle having an area equal to the projected area of the grain.

Early patent disclosures on high aspect tabular grains, e.g. U.S. Pat. Nos. 4,434,226; 4,439,520; 4,425,425; 4,425,426; 4,433,048 and Research Disclosure, Vol. 225, January 1983, Item 22534, are concerned with high sensitive silver bromide or silver iodobromide {111} tabular grain emulsions. In a lot of photographic applications however high sensitivity is less important. In these cases the use of emulsions rich in chloride is advantageous thanks to their higher development and fixing rates favourable in rapid processing applications. Typical examples include graphic arts contact materials, duplicating materials, hard-copy materials, diffusion transfer reversal materials and black-and-white or colour print materials. However when combined, high sensitivity and rapid processing applicability are highly appreciated. So it remains interesting to combine the advantages of emulsions rich in chloride with the advantages of a tabular grain structure.

Silver halide tabular grains rich in chloride can i.e. have parallel faces in the {111} crystal plane or in the {100} crystal plane, thus providing a tabular {111} or a tabular {100} habit respectively.

In earlier disclosures most attention was paid to the preparation of tabular grains rich in chloride having a {111} crystal habit as in U.S. Pat. Nos. 4,400,463; 4,713,323; 4,804,621; 5,183,732; 5,185,239; 5,178,998; 5,178,997 and in EP-A 0 481 133.

The first publications on tabular grains bounded by {100} parallel major faces were related with silver iodobromide emulsions. Bogg in U.S. Pat. No. 4,063,951 and Mignot in U.S. Pat. No. 4,386,156 were the most important publications.

In EP-A 0 534 395 Brust et al. disclose the first {100} tabular emulsion grains rich in chloride and a process for preparing them wherein the tabular grain fraction showing {100} major faces is significant. Further improvements and variations on the teachings of the said tabular {100} emulsions rich in chloride have been described in U.S. Pat. Nos. 5,024,931; 5,264,337; 5,275,930; 5,292,632; 5,310,635; 5,314,798; 5,320,938; 5,356,764; 5,601,967; 5,707,793; in WO-Applications 94/22051 and 94/22054 and in EP-A's 0 569 971; 0 584 815; 0 584 644; 0 602 878; 0 616 255; 0 617 317; 0 617 320; 0 617 321; 0 617 325; 0 618 492; 0 618 493; 0 653 659 and 0 653 669.

In conventional photographic materials for radiographic recording high-sensitive silver (iodo)bromide tabular emulsions are currently used. However with respect to recent trends to rapid processing applications it is desirable to use silver halide emulsions rich in chloride as the said emulsions show a faster developability as has e.g. been disclosed in EP-A 0 678 772.

One of the major problems arising in the preparation methods of {111} tabular grains rich in chloride is the problem of crystallographic stability, which after making use of a crystal habit modifier in the preparation step of the said grains requires the cumbersome step of replacing the said habit modifier by other compounds adsorbed at the large crystal surface as has e.g. been demonstrated in U.S. Pat. No. 5,221,602. Due to the steps of adsorbing, desorbing and replacing different adsorbing compounds the reproducibility and stability of the grains is questionable.

As has been shown e.g. in EP-A 0 653 669 during the preparation of {100} tabular grains rich in chloride the presence of such an adsorbed crystal habit modifier is not required as an excellent crystallographic stability is obtained. Moreover improved sensitometric characteristics, especially with respect to sensitivity, if compared with equivalent non-tabular cubic emulsion crystals are therein obtained.

As it has always been important to get a percentage of tabular grains as high as possible within the whole emulsion crystal population, in favour of all properties offered by the said tabular grains, it is clear that every improvement in that direction is highly appreciated. An attempt to reach that object, particularly for high chloride {100} tabular grains comprising iodide ions, has been described in U.S. Pat. No. 5,413,904, wherein it has been proposed as an indispensable asset to delay the introduction of iodide ions in the reaction vessel until after grain nucleation has occurred. Further measures improving good anisotropic growing properties, showing a very low growing speed in the thickness direction, thereby having more excellent uniformity among the grains have been described in U.S. Pat. No. 5,707,793.

The present invention further extends the teachings on tabular emulsions grains rich in chloride having a {100} crystal habit.

OBJECTS AND SUMMARY OF THE INVENTION

It is an object of the present invention to provide a method of preparing light-sensitive silver halide tabular emulsion grains rich in silver chloride having {100} major faces wherein homogeneity of crystal habit, thickness and crystal diameter of the said tabular grains is remarkably enhanced.

Other objects of the invention will become clear from the description hereinafter.

The objects of the present invention are realized by providing a method for preparing a light-sensitive silver halide photographic emulsion comprising performing at least three distinct precipitation steps in an aqueous medium into a reaction vessel, followed by desalting by means of flocculation and washing or by means of ultrafiltration, said emulsion comprising a colloidally stabilizing binder and {100} tabular silver halide grains containing at least 50 mole % of silver chloride, wherein at least 60% by number of all grains is provided by said tabular grains, and wherein said tabular grains exhibit an average aspect ratio of at least 2, an average thickness of at most 0.25 μm with a variation coefficient of at most 0.25, and an average equivalent circular crystal diameter of 0.3 μm or more with a variation coefficient of at most 0.20;

said three distinct precipitation steps being a nucleation step and two growth steps, said method being further characterized by introducing after ending the said nucleation step one or more crystal dislocation(s) onto nuclei formed in the said nucleation step in order to provide anisotropic growth of the said nuclei into {100} tabular grains, wherein introducing said crystal dislocation(s) is performed within a time taking no longer than the time required to perform a first physical ripening step after the nucleation step in order to get a number of dislocation lines of less than 5, in one and the same crystallographic plane, and wherein said physical ripening step between introducing said dislocation(s) and growing the nuclei having said dislocation(s) in a first growth step proceeds within a time interval from 2 to 10 minutes (more preferably from 5 to 10 minutes).

DETAILED DESCRIPTION OF THE INVENTION

As an essential feature precipitating in at least three distinct precipitation steps in a reaction vessel is mentioned. Said three distinct precipitation steps are, consecutively:

1.—a nucleation step, wherein from 1 to 20%, more preferably from 5 to 15% of the total available amount of silver nitrate is provided and wherein silver ions and halide ions are introduced at a flow rate in order to get cubic nuclei rich in silver chloride having a crystal edge of at most 0.25 μm. Therefore an approximately equimolecular addition is performed of silver salts and halide salts, preferably pure silver chloride salts, optionally having at most up to 5 mole % of bromide and/or at most up to 0.5 mole % of iodide (more preferably from 0.05 up to 0.3 mole %). The flow rate of the solutions is chosen in a way in order to get a crystal edge side, determining the thickness of the {100} tabular grains rich in silver chloride resulting therefrom. In a preferred embodiment said crystal edge is from 0.05 μm up to 0.25 μm and more preferably from 0.05 μm up to about 0.20 μm.

2.—a first growth step wherein an increasing flow rate of silver salt and halide salt solutions, preferably having a composition as in the nucleation step or differing therefrom, is preferably performed by e.g. a linearly increasing flow rate, particularly after running said silver and halide solutions in at a constant flow rate for at least half of the total nucleation time. Typically the flow rate at the end of this first growth step is about up to 5 times greater than at the start of the growth step, more preferably between 1 to 3 times and still more preferably between once and twice the starting flow rate;

3.—a second growth step wherein a further increasing flow rate of silver and halide solutions, preferably having a composition as in the first growth step or differing therefrom, is preferably performed by e.g. a linearly increasing flow rate. Typically the flow rate at the end of this second growth step is about up to 10 times greater than at the start of the growth step, more preferably between 1 to 5 times.

In the first as well as in the second growth step these flow rates can be monitored by e.g. magnetic valves. During the growth step(s) the pAg is preferably maintained at a constant value, made optionally variable in order to provide growth without further nucleation.

The pH is preferably established at a value of between 2.0 and 10.0 and more preferably between 3.0 and 9.0.

In order to provide homogeneity in that at least 60% by number, more preferably at least 75% and still more preferably at least 90% by number of the formed grains are {100} tabular crystals, it is of utmost importance to avoid additional formation of new nuclei during both growth steps.

Apart from the three distinct growth steps, in order to attain the desired {100} tabular grains rich in silver chloride, having at least 50 mole % of silver chloride, more preferably at least 70 mole % and still more preferably, more than 90 mole %, said tabular grains exhibiting an average aspect ratio of at least 2, an average thickness of at most 0.25 μm with a variation coefficient of at most 0.25, and an average equivalent circular crystal diameter of 0.3 μm or more with a variation coefficient of at most 0.30, it is an essential feature to have, between the nucleation and the first growth step, a crystal dislocation step wherein one or more dislocations is(are) introduced onto the nuclei formed in the nucleation step. Said variation coefficients are therein defined as the ratios calculated between standard deviation on the average magnitude and the average magnitude (of thickness and crystal diameter respectively). This step is, according to the method of the present invention, performed by making use therefore from introducing in the reaction vessel of at least one compound providing ions selected from the group consisting of iodide ions, bromide ions, complex anions as $CN^-$, $SCN^-$, $SeCN^-$, etc. and complex metal ions satisfying formula (I)

$$[ML_6]^{n-} \quad \text{(I)}$$

wherein M represents an element from group VIII in the periodic system of the elements (Table of Mendelejew), preferably the following metal ions, being $Ru^{2+}$, $OS^{2+}$, $Rh^{3+}$, $Ir^{3+}$ or $Pt^{2-}$;

$L_6$ represents six coordination complex ligands which are independently selected, provided that at least three of the said ligands are more electronegative than any halide ligand and at least four of the said ligands are anionic ligands, e.g. $CN^-$, $SCN^-$, $SeCN^-$, etc; and n=1, 2, 3 or 4.

Introduction of dislocation lines in crystals making use of metal dopants has e.g. been described in JP-A's 07-712778, 07-219097, 07-219097, 07-128769 and 8-171159; and in Research Disclosure No. 377025, p. 607–608, published Sep. 1, 1995.

Preferred group VIII metal ions used in the method according to the present invention, introducing a crystal dislocation onto the nuclei formed are e.g. $Ru^{2+}$, $Os^{2+}$, $Rh^{3+}$, $Ir^{3+}$ or $Pt^{2+}$. Especially preferred are complex ion compounds of ruthenium, and more preferably hexacyanoruthenium salts thereof. Group VIII metal ions useful in the method of the present invention have been described as dopants in silver halide crystals in the patent literature or in RD's as in U.S. Pat. No. 4,981,781 (Ru,Fe,Rh,Os); U.S. Pat. No. 5,024,931 (Ru,Rh,Os,Ir,Pd,Pt); U.S. Pat. No. 5,252,456 (Pt,Ir) and U.S. Pat. No. 5,360,712 and EP-A's 0 336 426 (Ru,Os); 0 336 427 (Ru,Os); 0 415 481 (Rh,Ir,O,,Ru,Fe,Co). Most frequently occurring dopants in literature are ruthenium, rhodium and iridium. Combinations of one or more dopant(s) may be added, in the same or different preparation steps of the {100} tabular silver halide crystals rich in silver chloride.

According to the method as described in the present invention, said iodide ions and/or bromide ions are preferably provided by means of an organic iodide or bromide releasing agent. Such releasing agents have e.g. been described in U.S. Pat. Nos. 5,389,508; 5,482,826; 5,498,516; 5,524,660 and 5,527,664; and in EP-A 0 651 284.

Alternative techniques in order to create dislocations as set forth in the method of the present invention are however not excluded.

According to the method of the present invention it is the purpose of this step to introduce thereby crystal dislocation (s) in the nuclei formed in the nucleation step in order to provide anisotropic growth of the said nuclei into {100} tabular grains as a function of desired equivalent crystal diameter. Therefore it is important, in accordance with the method of the present invention, to introduce said crystal dislocation in a time no longer than the time required to perform a first physical ripening step after the nucleation step, in order to get a number of dislocation lines of less than 5, more preferably of less than 3, thus corresponding with a number of 1 or 2 of the said dislocation lines, wherein it is of utmost importance that said dislocation lines are lying in one and the same crystallographic plane in order to get two-dimensional growth, thus avoiding thickness growth.

Said physical ripening step following introducing said dislocation line or lines and growing the nuclei formed in the nucleation step during the first growth step immediately following said physical ripening step is within a time interval from 2 to 10 minutes, more preferably from 5 to 10 minutes according to the method of the present invention. Introducing the said crystal dislocations has a minor influence on crystal thickness as long as low amounts of e.g. iodide ions are added. Opposite thereto higher amounts introduce more dislocation lines and/or dislocation lines that are not lying in one and the same crystallographic plane during growth of the formed nuclei, thereby causing three-dimensional (thickness) growth.

Introducing crystal dislocations, thereby generating dislocation lines that should be situated in one and the same crystallographic plane is thus decisive in order to get the desired equivalent circular diameter (ECD) of the {100} tabular crystals rich in silver chloride as set forth.

Whereas nucleation is mainly determining the thickness of the tabular {100} silver halide grains, being not more than 0.25 μm as set forth in the present invention, the first growth step is required in order to increase the "Ostwald ripening pressure" between "non-dislocated" and "dislocated" grains in order to stimulate Ostwald (physical) ripening during the physical ripening time between the first and the second growth step, in order to make disappear the. "non-dislocated" grains.

During the second physical ripening step the said Ostwald ripening makes further disappear fine crystals, thereby causing an increased homogeneity in equivalent circular crystal diameter at the end of the preparation.

It is further not excluded to introduce further physical ripening steps and/or growth steps. At the end of the precipitation it is moreover possible to introduce halide ions or complex anions forming a less soluble silver salt than the silver salt present at the surface of the formed {100} tabular grains rich in silver chloride. In that way surface conversion by e.g. iodide in form of iodide ions or in form of a fine silver iodide micrate emulsion grains having a crystal diameter of not more than 0.050 μm in amounts favourable to enhance spectral sensitization properties and/or to decrease pressure sensitivity is highly appreciated.

Before and during formation of the silver halide nuclei rich in silver chloride, preferably being pure silver chloride, it is common practice to establish a concentration of colloidally stabilizing binder in amount from about 0.05%, more preferably from about 1% and still more preferably from 5–10% up to 100% by weight of the total available amount of stabilizing binder in the dispersion medium in the reaction vessel before or during nucleation. If gelatin is used as colloidally stabilizing binder 100% by weight of gelatin is even preferred.

According to the method of the present invention said colloidally stabilizing binder is a compound selected from the group consisting of gelatin, a hydrophilic amphoteric block-copolymer, colloidal silica or a combination thereof. Use of colloidal silica in the preparation of {100} tabular grains has been described in EP-A 0 767 400, whereas use of hydrophilic amphoteric block-copolymers has been described in U.S. Pat. Nos. 5,147,771; 5,147,772; 5,147,773 and 5,385,819.

According to the present invention the preferred colloidally stabilizing binder used in the nucleation step is so-called "oxidized" gelatin, wherein said gelatin has a methionine content of at most 4000 ppm. In a more preferred embodiment said gelatin is oxidized to a degree in order to have a methionine content of at most 1500 ppm. In a further preferred embodiment according to the present invention said gelatin is substantially free from calcium ions and is called "deionized" gelatin.

Additional gelatin may be added in a later stage of the emulsion preparation e.g. after washing, in order to establish optimal coating conditions and/or in order to establish the required thickness of the coated emulsion layer. That gelatin can be conventional (calcium) containing non-oxidized gelatin, having high amounts of methionine, but calcium free and/or oxidized gelatin is not excluded. Preferably a ratio by weight of gelatin to silver halide ranging from 0.2 to 1.0 is then obtained, wherein silver halide is expressed as an equivalent amount of silver nitrate.

"Oxidized gelatin" is, according to Maskasky in U.S. Pat. No. 4,713,323, defined as a gelatin having a methionine content of less than 30 μmole/g, which corresponds with an amount of about 4400 ppm or less. Gelatin can be oxidized by means of e.g. hydrogen peroxide. A publication on the determination of methionine and its oxides in gelatin can be found e.g. in *J. Phot. Sci., Vol.* 41, (1993), p. 172–175, by S. Tani and T. Tani.

A high number of tabular grains rich in bromide in the total grain population is obtained if use is made in the preparation method of so-called "oxidized gelatin", characterized by the presence in the said gelatin of amounts of methionine of less than 30 μmoles per gram of gelatin as claimed in U.S. Pat. No. 4,713,320. Opposite thereto the same author discloses a preparation process of high chloride tabular grain emulsions wherein use is made of a high methionine gelatino-peptizer, in the presence of specified pyrimidine grain growth modifiers. A high number of tabular {100} grains has been reached in a preferred silver chloroiodide emulsion prepared by the method described in U.S.

Pat. No. 5,413,904, wherein from the Examples the presence in the reaction vessel of oxidized gelatin seems to be an essential feature, although it has not specifically been claimed therein, whereas nothing therein refers to the presence of gelatin substantially free from calcium ions as a second, preferably simultaneously present and essential feature, as e.g. set forth in EP-A 0 843 207.

A preparation method of tabular grain emulsions wherein in the grain growth process use is made of gelatin derivatives with chemically modified $NH_2$-groups and wherein said gelatin has a specific methionine content has been described in EP-A 0 697 618. Modification of the methionine content of a gelatino-dispersion medium by means of an oxidizer which should be added to the reaction vessel immediately before nucleation formation has been described in U.S. Pat. No. 5,372,975, wherein seed grains are further added. Seed grains formed in the presence of an oxidizing agent have been described in JP-A 05-210187, in JP-A 06-003758 and in JP-A 06-003759. Processing a gelatin solution by means of $H_2O_2$ has e.g. been described in JP-A 05-341415. other oxidizing agents besides hydrogen peroxide as e.g. ozone, peroxy acid salts, halogens, thiosulphonic acid salts, quinones and organic peroxides have been used in U.S. Pat. No. 5,489,504. Further in order to provide tabular grains having small twin-plane separations in tabular grains rich in silver bromide a preparation method making use of oxidized gelatin has been described in U.S. Pat. No. 5,219,720. Oxidation of methionine reduces the complexing ablity of gelatin. Modification of complexing ability can be performed in different steps during precipitation, as e.g. in the precipitation of silver halide tabular grains as has described in JP-A 07-311428, wherein hydrogen peroxyde is added after nucleation, during the following physical ripening step.

A preparation method of gelatin having a controlled methionine content is disclosed in U.S. Pat. No. 5,412,075. In order to determine the methionine content of gelatin in a quantitative manner many references from literature are available as e.g. in J.Phot.Sc., Vol. 28(1980), p.111–118 wherein as most obvious reducing substances in gelatin methionine residues of the macromolecule are determined in reaction with Au(III)-ions. The so-called "gold number" permits determination of amounts of methionine in the gelatin following the rule that 1 mmole of Au corresponds with 1.6 mmole of methionine. In J.Phot.Sc., Vol. 33(1989), p.10–17 the methionine content was determined using the gaschromatographic procedure developed by Apostolatos and Hoff (Anal. Biochem. Vol. 118(1981), p.126) and applied to gelatin by Rose and Kaplan. In this article calorimetry is used in a quantitative procedure for determining methionine (constant over initial pH range examined: 3.0–8.0). In J.Phot.Sc., Vol. 40(1992), p.149–151 amounts of methionine, methionine sulphoxide and methionine sulphone are determined by a chromatographic technique for amino acids (Hitachi Amino Acid Analyser), whereas in J.Phot.Sc., Vol. 41(1993), p.172–175 these compounds are determined by HPLC-techniques. In J.Phot.Sc., Vol. 39(1995), p. 367–372 it has been established that a good correlation between methionine content determined by Rose and Kaplan making use of gas chromatographic techniques (4th IAG Conference, Fribourg 1985, Amman-Brass & Pouradier) and the Scatchard technique (described in J.Phot.Sc., Vol. 42(1994), p.117–119) can be found. In the said technique the interaction at pH=3.0 of $Ag^+$ and gelatin is determined by means of potential measurements of free $Ag^+$-ions.

It is of utmost importance to make use of the said "oxidized" gelatin during nucleation, wherein in a preferred embodiment less than 2500 ppm of methionine is present in the said gelatin, and wherein in a still more preferred embodiment said methionine content is less than 1500 ppm. In a more preferred embodiment according to the method of the present invention the said "oxidized" gelatin is free from calcium. The calcium content of most commercial high-quality inert gelatins is about 0.4% or about 100 mmole/kg, measured at the end of the preparation process of inert gelatin. The basis for a high-quality gelatin is preferably formed by pure, degreased hard cattle bones. In a first preparation step the bones are treated with acid in order to remove calcium and magnesium phosphates. This step is followed by an alkaline hydrolysis step, wherein mostly use is made of calcium hydroxide. At the low pH used to remove the phosphates the calcium ions, bound to specific amino acids of the polypeptide, are exchanged with the protons from the used acid. During the alkaline hydrolysis with calcium hydroxide the polypeptide is saturated with calcium ions again. After diafiltration the non-removable calcium concentration in the gelatin is about 0.5% or 125 mmol/kg. When slightly acidifying during washing the calcium content can be reduced to about 0.4% (40 ppm) or 100 mmol/kg. These and other data can be found in the scientific publication "Influence of Calcium on the Physical properties of Gelatin Solutions and on Symplex Formation with Macromolecular Polyanions" by B. H. Tavernier, *J. Phot. Sci.*, Vol. 40, (1992), p. 168–173. The author came to the conclusion that complex-bound calcium ions strongly decrease the electric potential carried by gelatin. The influence of calcium ions on physicaL characteristics such as viscosity was found to be non-significant.

The preferred so called "calcium free gelatin" is obtained by cation exchange by means of an ion exchange resin, preferably a so-called mixed-bed resin. Substantially "calcium free gelatin" is thus defined as gelatin with a calcium content at a level below 40 ppm which corresponds with the analytical detection limit.

Patent references on gelatins free from calcium or poor in calcium are rather scarce. In JP-A 05-173278 a colour negative material has been described hardened with a vinyl sulphonyl hardener type and containing a calcium poor gelatin. In JP-A 04-321026 a black-and-white multicontrast material has been disclosed using a specific calcium poor gelatin. In JP-A 02-300745 a specific AgX material has been described comprising gelatin with a calcium content of less than 100 ppm. In that reference especially sensitometric improvements have been described. Further influences on chemical ripening properties, especially with respect to fog, have been described in JP-A 62-006251. Improvements with respect to coating properties can be read in U.S. Pat. Nos. 5,188,931 and 5,496,691 and in JP-A 03-174142. Influences on viscosity making further use of small amounts of viscosity increasing agents have been described in JP-B 92-062064. Prevention of roller marks thanks to the use of gelatin containing less calcium has been described in JP-A 01-179141, whereas adhesion properties and curl of materials comprising a defined calcium ion content have been described in U.S. Pat. No. 5,496,691. Influences on surface glare have been described in JP-B 91-080292. Drying properties of materials run in rapid processing applications of a material having a well-defined amount of calcium in its gelatinous binder have been described in JP-A's 01-073337, 03-253839 and 07-140576; and in U.S. Pat. Nos. 5,318,881 and 5,302,505.

In EP-A 0 843 207 a method is disclosed of preparing of a photographic silver halide emulsion comprising precipitating in one or more precipitation steps in a reaction vessel, followed by desalting by means of flocculation and washing or by means of ultrafiltration, said emulsion comprising gelatin as a binder and {100} tabular silver halide grains containing at least 50 mole % of chloride, wherein at least 40% by number of all grains is provided by said tabular grains, and wherein said tabular grains exhibit an average aspect ratio of at least 2, an average thickness of at most 0.5 μm, and an average equivalent circular crystal diameter of 0.3 μm or more, characterized in that during said precipitation step(s) said gelatin binder present in said reaction vessel is substantially free of calcium ions and is oxidized to a degree in order to have a methionine content of at most 4000 ppm.

After completion of precipitation step, eventually followed by a further conversion and/or physical ripening step, a wash technique in order to remove the excess of soluble salts is applied. Any conventional wash technique can be used e.g. washing with several water portions after flocculation by an inorganic salt or by a polymeric flocculating agent like polystyrene sulphonic acid. Emulsion washing has e.g. been described in Research Disclosure N° 38957 (1996), Chapter III. In a preferred embodiment ultrafiltration is used as wash technique. Such procedure has been disclosed e.g. in Research Disclosure, Vol. 102, October 1972, Item 10208; in Research Disclosure Vol. 131, March, Item 13122 and in Mignot U.S. Pat. No. 4,334,012.

The emulsion prepared according to the method of the present invention thus comprises {100} tabular silver halide grains containing at least 50 mole % of silver chloride, more preferably at least 70 mole % of silver chloride and still more preferably at least 90 mole % of silver chloride.

In the said emulsion at least 60%, more preferably at least 75% and still more preferably at least 90% by number of all grains is provided by said tabular grains, wherein said tabular grains exhibit an average aspect ratio of at least 2, more preferably from 3 to 50 and still more preferably from 5 to 25; an average thickness of at most 0.25 μm, preferably from 0.05 up to 0.20 μm, with a variation coefficient of at most 0.20 and an average equivalent circular crystal diameter of 0.3 μm or more, preferably 0.8 μm or more, more preferably from 1.2 up to 10 μm and still more preferably up to 5 μm with a variation coefficient of not more than 0.30 and more preferred not more than 0.25.

As tabular grains rich in chloride having a {100} crystal habit as in the present invention do not require use of a crystal habit modifier during the emulsion preparation as is the case during preparation of {111} tabular grains, this is particularly in favour of reproducibility.

In a preferred embodiment the emulsion prepared according to the method of the present invention is an emulsion comprising {100} tabulair silver chloroiodide grains. In particular the iodide ions used therein are located at the surface of the {100} grains as a result of an iodide conversion step at the end of the preparation, thereby making the silver iodide concentration increase in the vicinity of the crystal surface and reaching the highest concentration at the crystal surface.

It is specifically contemplated that up to at most 3 mole % of iodide ions are incorporated in the said silver chloroiodide grains by the method as described hereinbefore. This is in one embodiment achieved by mixing a soluble chloride and a soluble iodide salt, like potassium iodide, in one or more of the halide solutions up to the desired mole % concentrations required in each preparation step or by a triple jet technique with separate addition of an iodide containing aqueous solution. Due to the about $10^6$ times lower solubility of silver iodide ions in comparison with silver chloride, said iodide ions are able to displace chloride ions from the grain, a technique known in the art as conversion. Iodide ions are in another embodiment incorporated into the silver halide crystal lattice by the addition of a previously prepared silver iodide micrate emulsion, composed of either pure silver iodide or mixed halides, but in a preferred embodiment iodide is provided by means of an iodide releasing agent. Patent applications referring to methods wherein iodide releasing agents are used are e.g. EP-A's 0 563 701, 0 563 708, 0 561 415 and 0 651 284. Even bromide releasing agents are not excluded in the precipitation steps according to the method of the present invention if bromide ions are incorporated in the {100} tabular grains rich in chloride prepared according to the method of the present invention.

Two or more types of tabular silver halide emulsions that have been prepared differently can be mixed for forming a photographic emulsion for use in accordance with the present invention.

The size distribution of the {100} tabular silver halide grains rich in chloride prepared according to the method of the present invention is thus monodisperse in thickness and in crystal diameter in that a variation coefficient of at most 0.25 and 0.30 is measured respectively, more preferably even at most 0.20 and 0.25 respectively.

Tabular silver halide emulsions comprising tabular {100} grains rich in silver chloride prepared by the method of the present invention can be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulfur e.g. thiosulphate, thiocyanate, thioureas, its selenium or its tellurium analogues, sulfites, mercapto compounds, and rhodamines. The emulsions can be sensitized also by means of gold-sulfur ripeners, or gold-selenium ripeners, or gold-sulphur-selenium ripeners, wherein in addition of or instead of selenium ripeners tellurium compounds may be added, or by means of reductors e.g. tin compounds as described in GB-Patent 789,823, amines, hydrazine derivatives, formamidine sulfinic acids, toluene thiosulfonic acid and silane compounds. A general review of chemical sensitization can be found in Research Disclosure No. 38957, Chapter IV, published Sep. 1, 1996. Specifically useful selenium sensitizers have been described e.g. in EP-A's 0 476 345, 0 831 363 and 0 862 088.

The silver halide emulsions under consideration can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in Research Disclosure No. 38957 mentioned hereinbefore, Chapter Va.

oxacarbocyanines have been described e.g. in U.S. Pat. No. 5,434,042. Especially preferred green sensitizers in connection with the present invention are anhydro-5,5'-dichloro-3,3'-bis(n.sulfobutyl)-9-ethyl-oxacarbocyanine hydroxide and anhydro-5,5'-dichloro-3,3'-bis (n.sulfo-propyl)-9-ethyl-oxacarbocyanine hydroxide.

Imidacarbocyanines as e.g. those described in Research Disclosure N° 37312 (1995) may be useful as well as combinations of oxacarbocyanines and imidacarbocyanines as in EP-A 0 590 593 from the viewpoint of sensitivity as well as from the viewpoint of decolouring properties and stain removal in the processing of materials containing spectrally sensitized tabular grains. A suitable mixture of oxacarbocyanine and imidacarbocyanine spectral sensitizers that is applied in favour of decolouring properties and sensitometry is e.g. anhydro-5,5'-dichloro-3,3'-bis(n-sulfobutyl)-9-ethyl oxacarbocyanine hydroxide or anhydro-5,5'-dichloro-3,3'-bis(n-sulfopropyl)-9-ethyl-oxacarbocyanine hydroxide together with anhydro-5,5'-dicyano-1,1'-diethyl-3,3'-di(2-acetoxyethyl)ethyl-imidacarbocyanine bromide.

In classical emulsion preparation spectral sensitization traditionally follows the completion of chemical sensitization. However, in connection with tabular grains, it is specifically considered that spectral sensitization can occur simultaneously with or even precede completely the chemical sensitization step. In the preferred embodiment wherein the tabular {100} emulsion is a chloroiodide emulsion the spectral sensitizers are preferably added even before digestion of an ultrafiltrated emulsion or redispersion of a flocculated and washed emulsion: chemical sensitization after spectral sensitization is believed to occur at one or more ordered discrete sites of the tabular grains. In praxis chemical sensitization may e.g. proceed in the presence of one or more phenidone and derivatives, a dihydroxy benzene as hydroquinone, resorcinol, catechol and/or a derivative(s) therefrom as e.g. sulfodihydroxy aryl compounds described in EP-A 0 718 682, one or more stabilizer(s) or antifoggant (s), one or more spectral sensitizer(s) or combinations of said ingredients. Especially 1-p-carboxyphenyl, 4,4' dimethyl-pyrazolidine-3-one may be added as a preferred auxiliary agent as disclosed in U.S. Pat. No. 5,447,826.

The gelatinous emulsion rich in silver chloride prepared according to the method of the present invention, is further coated in hydrophilic layer(s) which may, just as non-light-sensitive layers of the photographic material according to this invention, comprise compounds preventing the formation of fog or stabilizing the photographic characteristics during production or storage of the photographic elements or during the photographic treatment thereof. Many known compounds can be added as fog-inhibiting agent or stabilizer to the silver halide emulsion layer or to other coating layers in water-permeable relationship therewith such as an undercoat or a protective layer (as has been described e.g. in EP-A 528 480 wherein a 3-pyrazolidone compound is used). Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotria-zoles, mercaptotriazoles, mercaptotetrazoles, in particular 1-phenyl-5-mercapto-tetrazole and acetamido-1-phenyl-5-mercaptotetrazole, mercaptopyrimidines, mercaptotriazines, mercapto-imidazoles, mercapto-thiadiazoles, mercapto-oxadiazoles, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-Patents 1,203,757 and 1,209,146, in JP-A 7539537, and GB-Patent 1,500,278, and 7-hydroxy-s-triazolo-[1,5-a]-pyrimidines as described in U.S. Pat. No. 4,727,017, and other compounds such as benzenethiosulfonic acid, benzenethiosulfinic acid and benzenethiosulfonic acid amide, and sulfodihydroxy aryl compounds as in U.S. Pat. Nos. 5,491,055 and 5,631,126. Other compounds that can be used as fog-inhibiting compounds have been described in Research Disclosure N° 17643 (1978), Chapter VI and in RD N° 38957 (1996), Chapter VII. Many of these fog-inhibiting compounds may have been already added during the chemical ripening of the {100} tabular silver halide crystals rich in silver chloride as already set forth hereinbefore.

It is clear that additional gelatin may be added in a later stage of the emulsion preparation, e.g. after washing, in order to establish optimal coating conditions and/or in order to establish the required thickness of the coated emulsion layer. Preferably a gelatin to silver halide ratio ranging from 0.2 to 1.0 is then obtained, wherein extra gelatin added is not required to have a composition as specific as in the preparation step of the grains according to the method of the present invention. Another binder may also be added instead of or in addition to gelatin. Useful vehicles, vehicle extenders, vehicle-like addenda and vehicle related addenda have been described e.g. in Research Disclosure N° 38957 (1996), Chapter II.

The gelatin binder of the photographic material having at least one gelatinous emulsion according to the present invention can be forehardened with appropriate hardening agents such as those of the epoxide type, those of the ethylenimine type, those of the vinylsulfone type e.g. 1,3-vinylsulphonyl-2-propanol, bis-vinyl-sulfonyl-methane or ethane and those substituted with hydroxyl groups in order to provide a better solubility in aqueous medium, chromium salt s e.g. chromium acetate a nd chromium alum, aldehydes e.g. formaldehyde, glyoxal, and glutaraldehyde, N-methylol compounds e.g. dimethylol-urea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds disclosed in EP-A 0 408 143.

A review of hardening agents useful to harden the hydrophilic layers of the material comprising one or more {100} tabular silver halide grains rich in silver chloride, prepared according to the present invention can be found e.g. in RD 38957, Chapter IIb.

In a preferred embodiment the hydrophilic layer package of silver halide photographic materials comprising in one or more light-sensitive layers one or more {111} tabular emulsions rich in silver bromide crystals prepared according to the method of the present invention, has a swelling degree of not more than 200%. Said swelling degree is determined by means of the following procedure: a sample of the coated material is incubated at 57° C. and 34% RH for 3 days, whereafter the thickness (a) of the layer assemblage is measured. Thereafter the sample is immersed in distilled water at 21° C. for 3 minutes and the thickness (b) of the swollen layer is measured. The swelling ratio is then calculated as: $(b-a)/a \times 100$ (%).

The gelatinous emulsions comprising {100} tabular grains rich in silver chloride of the present invention can be used in various types of photographic elements e.g. black-and-white silver halide photographic materials, like materials used for X-ray diagnostic purposes, or colour sensitive materials.

In a preferred embodiment the photographic material is a photographic material comprising a support and at least one light-sensitive silver halide emulsion layer on at least one side of said support, wherein said emulsion layer(s) comprise(s) one or more emulsion(s) containing {100} tabular silver halide emulsion grains prepared according to the method of the present invention. In a further preferred embodiment said photographic material is a single or double side coated X-ray material.

The single-side coated X-ray material may contain one single emulsion layer, as it is the case for many applications, or it can be built up by two or even more emulsion layers. In X-ray photography a material with a single or a duplitized emulsion layer coated on one or both sides of the support thus contains at least one gelatinous silver halide emulsion according to the invention. By using duplitized emulsions differing in photographic speed by at least 0.15 log E a gain in cross-over exposure in double side coated materials can be obtained. In the case of colour photography the material contains blue, green and red sensitive layers each of which can be single coated as in most common colour positive materials, but merely consist of double or even triple layers as in colour negative or colour intermediate applications.

In a preferred embodiment according to the present invention said photographic material comprises at least two layers having negative image type silver halide emulsions adjacent to each other, wherein the emulsion layer more close to the said support comprises at least one emulsion having tabular emulsion crystals selected from the group consisting of silver chloride, silver chlorobromide, silver chloroiodide and silver chlorobromoiodide having a {100} crystal habit, prepared according to the method as described hereinbefore, wherein the adjacent layer(s) farther from the said support comprise(s) at least one emulsion having essentially cubic emulsion crystals selected from the group consisting of silver chloride, silver chlorobromide, silver chloriodide, silver chlorobromoiodide, silver bromide.and silver bromoiodide. This layer arrangement e.g. is particularly in favour of pressure insensitivity, but is also useful in order to improve image tone. Other measures to prove image tone have e.g. been given in EP-A 0 789 266 wherein leuco-dyes are described, forming a dye by reaction with oxidized developer in the vicinity of the developed grains. Leuco-dyes have already earlier been described for this purpose in U.S. Pat. No. 4,865,958.

Besides the light sensitive emulsion layer(s) the photographic material may contain several light-insensitive layers, e.g. a protective layer, one or more backing layers, one or more subbing layers, one or more intermediate layers e.g. filter layers and even an afterlayer containing e.g. the hardening agent(s), the antistatic agent(s), filter dyes for safety-light purposes, etc. The photographic element of the present invention may further comprise various kinds of coating physical property modifying addenda as described in RD N° 38957 (1996), Chapter IX, wherein coating aids, plasticizers and lubricants, antistats and matting agents have been described. Development acceleration can be accomplished by incorporating in the emulsion layer or adjacent layers various compounds, preferably polyalkylene derivatives having a molecular weight of at least 400 such as those described in e.g. U.S. Pat. Nos. 3,038,805; 4,038,075, 4,292,400 and 5,569,576 as well as in EP-A 0 634 688.

The photographic element of the present invention may further comprise various other additives such as e.g. compounds improving the dimensional stability of the photographic element, UV-absorbers and spacing agents.

Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, α-β-unsaturated dicarboxylic acids, hydroxyalkyl (meth)acrylates, sulfoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in RD N° 38957 (1996), Chapter VI, wherein also su itable optical brighteners are mentioned. UV-absorbers are especially useful in colour materials where they prevent fading by light of the colour images formed after processing.

Spacing agents can be present of which, in general, the average particle size is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophtha-late. Other suitable spacing agents have been described in U.S. Pat. No. 4,614,708.

The photographic material can contain several non-light sensitive layers, e.g. an antistress topcoat layer, one or more backing layers, and one or more intermediate layers eventually containing filter- or antihalation dyes that absorb scattering light and thus promote the image sharpness. Suitable light-absorbing dyes used in these intermediate layers are described in e.g. U.S. Pat. No. 4,092,168, U.S. Pat. No. 4,311,787, DE-A 2,453,217, and GB-Patent 7,907,440. Situated in such an intermediate layer between the emulsion layers and the support there will be only a small negligable loss in sensitivity but in rapid processing conditions decolouration of the filter dye layers may form a problem. Therefore it should be recommended to decrease the thickness of the whole coated layer packet resulting in shorter drying times after washing in the processing cycle. Alternatively the use of intermediate layers situated between emulsion layer(s) and support, reflecting the fluorescent light emitted by the screens may bring a solution. As the light emitted from the screens by the phosphors incorporated therein is a very important source of light-scattering the addition of appropriate filter dyes to the screens May he recommended. In the presence in the screens of e.g. green light-emitting phosphors use may be made of specific dyes as MAKROLEX ORANGE G or GG, trademarked products of BAYER, AG.

One or more backing layers can be provided a t the non-light sensitive side of the support of materials coated with at least one emulsion layer at only one side of the support. These layers which can serve as anti-curl layer can contain e.g. matting agents like silica particles, lubricants, antistatic agents, light absorbing dyes, opacifying agents, e.g. titanium oxide and the usual ingredients like hardeners and wetting agents.

The support of the photographic material may be opaque or transparent, e.g. a paper support or resin support. When a paper support is used preference is given to one coated at one or both sides with an α-olefin polymer, e.g. a polyethylene layer which optionally contains an antihalation dye or pigment. It is also possible to use an organic resin support e.g. cellulose nitrate film, cellulose acetate film, poly(vinyl acetal) film, polystyrene film, poly(ethylene terephthalate) or poly(ethylene naphthalate) film, polycarbonate film, polyvinylchloride film or poly-α-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide. A further survey of useful supports has been disclosed in RD 38957, Chapter 15.

The photographic material containing {100} tabular grains prepared according to the method of the present invention can be image-wise exposed by any convenient radiation source in accordance with its specific application.

Of course processing conditions and composition of processing solutions are dependent from the specific type of photographic material in which the {100} tabular grains rich in chloride prepared according to the present invention are applied. For example, in a preferred embodiment of materials for X-ray diagnostic purposes said materials may be adapted to rapid processing conditions in a developer containing hydroquinone as main developing agent or even free from hydroquinone: as a more ecological developing agent ascorbic acid (more preferred 1-ascorbic acid or iso-ascorbic acid), reductic acid or derivatives thereof may in part or integrally replace hydroquinone. Preferably an automatically operating processing apparatus is used provided with a system for automatic replenishment of the processing solutions.

The forehardened material may be processed using one-part package chemistry or three-part package chemistry, depending on the processing application determining the degree of hardening required in said processing cycle. Applications within total processing times of 30 seconds and lower up to 90 seconds, known as common praxis, are possible. From an ecological point of view it is e.g. possible to use sodium thiosulphate instead of ammonium thiosulphate.

The following examples illustrate the invention without however limiting it thereto.

EXAMPLES

Preparation of Emulsion A (inventive emulsion)

1160 ml of a dispersion medium (C) containing 156 g of gelatin containing 800 ppm of methionine and containing less than 40 ppm of calcium ions was provided in a stirred reaction vessel. The pCl was adjusted with sodium chloride to a value of 2.0; pH was adjusted to a value of 5.7 and the reaction vessel was held at a constant temperature of 35° C.

While vigourously stirring this solution, 76 m., of a 2.94 molar solution of silver nitrate and 76 ml of a 2.94 molar solution of sodium chloride were added simultaneously at a rate of 80 ml per minute by double jet precipitation.

Into the said reaction vessel 1250 ml of a solution containing 456 mg of potassium iodide and 600 mg of sodium chloride was poured and the temperature of the mixture was raised to 50° C. during the next 5 minutes. (1)

–58 ml of a 2.94 molar solution of a silver nitrate solution and 58 ml of a 2.94 molar solution of a sodium chloride were added simultaneously at a rate of 8 ml per minute each, while maintaining the pCl value at 2.2 and the temperature at 50° C.

–119 ml of a 2.94 molar solution of a silver nitrate solution and 119 ml of a 2.94 molar solution of a sodium chloride were further added simultaneously at a linearly increasing addition rate for both starting from 8 ml up to 12 ml per minute while the pCl value decreased from 2.2 to 1.8 and while the temperature was raised from 50° C. to 65° C.

The temperature of the mixture in the reaction vessel was further held at a value of 65° C. for 20 minutes.

477 ml of a 2.94 molar solution of a silver nitrate solution and 477 ml of a 2.94 molar solution of a sodium chloride were further added simultaneously at a linearly increasing addition rate for both starting from 8.8 ml up to 28 ml per minute while maintaining the pCl value at 1.8 at 65° C.

The temperature of the mixture in the reacticn vessel was further held at a value of 65° C. for 30 minutes.

Into the mixture obtained in the reaction vessel 80 ml of a solution containing 2 g of potassium iodide were poured. (2)

By double jet precipitation 70 ml of a solution of 2.94 molar of silver nitrate and 70 ml of a solution containing 2.94 molar of sodium chloride were added simultaneously at a rate of 8 ml per minute while maintaining the pCl value at 1.8 and the temperature at 65° C.

P.S. The steps (1) and (2) described hereinbefore are both so-called "iodide conversion steps".

Preparation of Emulsion B (comparative emulsion without iodide addition after nucleation)

The same preparation method as for Emulsion A was performed in order to prepare a tabular silver chloro emulsion except for the iodide addition step (1), thus in the absence of creating dislocations onto the formed nuclei.

Preparation of Emulsion C (comparative emulsion with only two distinct precipitation steps)

1160 ml of a dispersion medium (C) containing 156 g of gelatin containing 800 ppm of methionine and containing less than 40 ppm of calcium ions was provided in a stirred reaction vessel. The pCl was adjusted with sodium chloride to a value of 2.0; pH was adjusted to a value of 5.7 and the reaction vessel was held at a constant temperature of 35° C.

While vigourously stirring this solution, 76 ml of a 2.94 molar solution of silver nitrate and 76 ml of a 2.94 molar solution of sodium chloride were added simultaneously at a rate of 80 ml per minute by double jet precipitation.

Into the said reaction vessel 1250 ml of a solution containing 456 mg of potassium iodide and 600 mg of sodium chloride was poured and the temperature of the mixture was raised to 65° C. during the next 25 minutes.

724 ml of a 2.94 molar solution of a silver nitrate solution and 724 ml of a 2.94 molar solution of a sodium chloride were added simultaneously at a rate of 4 ml per minute each, while maintaining the pCl value at 1.98 and the temperature at 65° C.

In the Table 1 hereinafter following parameters and measured values related therewith have been summarized:

–% tabs: procentual amount by number of {100} tabular grains having a thickness of at most 0.25 μm in the emulsion as counted from photographs taken from electron microscopic investigations;

t: average thickness of the {100} tabular grains calculated from shadowed grains on photographs from electron microscopic images;

var.coeff.: variation coefficient on thickness as calculated from the ratio of the standard deviation on average thickness and the thickness of the individual grains;

ECD: average equivalent circular diameter, calculated from electron microscopic images and defined as diameter of a circle having the same area as the projected area of the measured {100} tabular grains.

TABLE 1

| Emulsion | % tabs | t (μm) | var.coeff. | ECD (μm) |
|---|---|---|---|---|
| A (inv.) | >75 | 0.13 | 0.25 | 1.37 |
| B (comp.) | <48 | 0.32 | 0.61 | 1.52 |
| C (comp.) | <1 | —* | —* | —* |

*:impossible to determine.

As can be concluded from Table 1 {100} tabular grain emulsions rich in silver chloride prepared according to the method of the present invention clearly provide a remarkably improved homogeneity on crystal habit (see % tabs) and on thickness (t) (see variation coefficient, called "var.coeff." in the Table 1) for grains having an ECD of 0.3 μm or more, according to the objects of the present invention.

Preparation methods without introduction of dislocations onto the nuclei formed (comparative emulsion.B) or in only two distinct precipitation steps (comparative emulsion.c) clearly don't lead to the desired objects as set forth.

Having described in det ail preferred embodiments of the current invention, it will now be apparent to those skilled in the art that numerous modifications can be made therein without departing from the scope of the invention as defined in the following claims.

What is claimed is:

1. Method for preparing a light-sensitive silver halide photographic emulsion comprising performing at least three distinct precipitation steps in an aqueous medium into a reaction vessel, followed by desalting by means of flocculation and washing or by means of ultrafiltration, said emulsion comprising gelatin having a methionine content of at most 800 ppm as a colloidally stabilizing binder and {100} tabular silver halide grains containing at least 50 mole % of silver chloride, wherein at least 60% by number of all grains is provided by said tabular grains, and wherein said tabular grains exhibit an average aspect ratio of at least 2, an average thickness of at most 0.25 μm with a variation coefficient of at most 0.25, and an average equivalent circular crystal diameter of 0.3 μm or more with a variation coefficient of at most 0.20; said three distinct precipitation steps being a nucleation step and two growth steps, said method being further characterized by introducing after ending the said nucleation step one or more crystal dislocation(s) onto nuclei formed in the said nucleation step in order to provide anisotropic growth of the said nuclei into {100} tabular grains, wherein in the said nucleation step from 5 to 15% of the total available amount of silver nitrate is provided and wherein silver ions and halide ions are introduced in order to get cubic nuclei rich in silver chloride having an edge of at most 0.25 μm, wherein introducing said crystal dislocation(s) is performed within a time taking no longer than the time required to perform a first physical ripening step after the nucleation step in order to get a number of dislocation lines of less than 5, in one and the same crystallographic plane, and wherein said physical ripening step between introducing said dislocation(s) and growing the nuclei having said dislocation(s) in a first growth step proceeds within a time interval from 2 to 10 minutes.

2. Method according to claim 1, wherein said physical ripening step between introducing said dislocation(s) and growing the nuclei having said dislocation(s) in a first growth step proceeds within a time interval from 5 to 10 minutes.

3. Method according to claim 1, wherein said {100} tabular silver halide grains are containing at least 90 mole % of chloride.

4. Method according to claim 1, wherein said gelatin is substantially free from calcium ions.

5. Method according to claim 1, wherein introducing said crystal dislocation(s) is performed in a time taking no longer than the time required to perform a first physical ripening step after the nucleation step in order to get a number of dislocation lines in one and the same crystallographic plane of less than 3.

6. Method according to claim 1, wherein introducing a crystal dislocation onto the nuclei formed in the nucleation step is performed by introducing in the reaction vessel at least one compound providing ions selected from the group consisting of iodide ions, bromide ions, complex anions and complex metal ions satisfying formula (I)

$$[ML_6]^{n-} \quad \text{(I)}$$

wherein M represents an element from group VIII in the periodic 35 table of the elements; $L_6$ represents six coordination complex ligands which are independently selected, provided that at least three of the said ligands are more electronegative than any halide ligand, at least four of the said ligands are anionic ligands and n=1, 2, 3 or 4.

7. Method according to claim 6, wherein said iodide ions and/or said bromide ions are provided by means of an organic iodide or bromide releasing agent.

8. Method according to claim 1 wherein at least 75% by number of all grains is provided by said tabular grains.

* * * * *

UNITED STATES PATENT AND TRADEMARK OFFICE

CERTIFICATE OF CORRECTION

PATENT NO. : 6,083,678

DATED : July 4, 2000

INVENTOR(S) : Peter Verrept et al

It is certified that error appears in the above-identified patent and that said Letters Patent is hereby corrected as shown below:

Column 5, line 5, "(Rh, Ir, O, Ru, Fe, Co)" should read -- (Rh, Ir, Os, Ru, Fe, Co) --.

Column 7, line 20, "other" should read -- Other --.

Column 10, line 64, "oxacarbocyanines" should read -- Oxacarbocyanines --.

Column 12, line 35, "salt s" should read -- salts --.

Column 12, line 35, "a nd" should read -- and --.

Column 14, line 20, "su itable" should read -- suitable --.

Column 14, line 59, "BAYER, AG" should read -- BAYER AG --.

Column 14, line 60, "a t" should read -- at --.

Column 15, line 55, "76 m.," should read -- 76 ml --.

UNITED STATES PATENT AND TRADEMARK OFFICE

CERTIFICATE OF CORRECTION

PATENT NO. : 6,083,678

DATED : July 4, 2000

INVENTOR(S) : Peter Verrept et al

It is certified that error appears in the above-identified patent and that said Letters Patent is hereby corrected as shown below:

Column 17, line 21, "de tail" should read -- detail --.

Column 18, line 38, "periodic 35 table" should read -- periodic table --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*